US010276290B2

(12) United States Patent
Park et al.

(10) Patent No.: US 10,276,290 B2
(45) Date of Patent: Apr. 30, 2019

(54) ELECTRONIC COMPONENT AND METHOD FOR MANUFACTURING SAME

(71) Applicant: SAMSUNG ELECTRO-MECHANICS CO., LTD., Suwon-Si, Gyeonggi-Do (KR)

(72) Inventors: Jeong Hyun Park, Suwon-Si (KR); Ki Hyun Park, Suwon-Si (KR); Kyu Ho Lee, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 302 days.

(21) Appl. No.: 14/924,213

(22) Filed: Oct. 27, 2015

(65) Prior Publication Data

US 2016/0141090 A1 May 19, 2016

(30) Foreign Application Priority Data

Nov. 14, 2014 (KR) ..... 10-2014-0158747

(51) Int. Cl.

| | |
|---|---|
| ***H01F 17/04*** | (2006.01) |
| ***H01F 5/00*** | (2006.01) |
| ***H01F 27/28*** | (2006.01) |
| ***H01F 41/02*** | (2006.01) |
| *H01F 17/00* | (2006.01) |
| *H01F 27/29* | (2006.01) |

(52) U.S. Cl.

CPC ..... *H01F 17/04* (2013.01); *H01F 41/0233* (2013.01); *H01F 17/0013* (2013.01); *H01F 27/292* (2013.01); *H01F 2017/048* (2013.01)

(58) Field of Classification Search

USPC ..... 336/221, 200, 232

See application file for complete search history.

(56) References Cited

U.S. PATENT DOCUMENTS 5,043,313 A * 8/1991 Mori ..... B41M 5/3336 427/150
5,070,625 A * 12/1991 Urquhart ..... F26B 3/283 34/268
5,336,588 A * 8/1994 Ueda ..... G03C 5/265 430/465
5,358,659 A * 10/1994 Ziolo ..... B82Y 25/00 252/62.54
2002/0167387 A1 11/2002 Tamezawa et al.
2007/0159282 A1 * 7/2007 Huang ..... H01F 27/255 336/83

(Continued)

FOREIGN PATENT DOCUMENTS

JP 2001-319812 A 11/2001
JP 2007-067214 A 3/2007

(Continued)

OTHER PUBLICATIONS

Office Action issued in Korean Patent Application No. 10-2014-0158747 dated Feb. 28, 2019, with English translation.

*Primary Examiner* — Elvin G Enad
*Assistant Examiner* — Kazi S Hossain
(74) *Attorney, Agent, or Firm* — Morgan Lewis & Bockius LLP

(57) ABSTRACT

An electronic component includes a magnetic body containing internal coil parts, wherein the magnetic body includes a magnetic metal powder; a thermosetting resin; and a color coupler.

9 Claims, 4 Drawing Sheets

(56) References Cited

U.S. PATENT DOCUMENTS

| | | | | |
|---|---|---|---|---|
| 2007/0176992 | A1* | 8/2007 | Arai | C09D 11/32<br>347/100 |
| 2008/0073613 | A1* | 3/2008 | Sugiura | B05D 3/207<br>252/62.54 |
| 2009/0078457 | A1* | 3/2009 | Atsumi | H01F 17/0006<br>174/262 |
| 2009/0310921 | A1* | 12/2009 | Kurita | G02B 6/4201<br>385/88 |
| 2013/0263440 | A1 | 10/2013 | Lee et al. | |
| 2015/0235749 | A1* | 8/2015 | Huang | H01F 3/02<br>336/178 |

FOREIGN PATENT DOCUMENTS

| | | | |
|---|---|---|---|
| JP | 2007-109934 | A | 4/2007 |
| JP | 2007-189205 | A | 7/2007 |
| JP | 2008-166455 | A | 7/2008 |
| KR | 10-2013-0072816 | A | 7/2013 |

* cited by examiner

ELECTRONIC COMPONENT AND METHOD FOR MANUFACTURING SAME

CROSS-REFERENCE TO RELATED APPLICATION

This application claims the benefit of priority to Korean Patent Application No. 10-2014-0158747, filed on Nov. 14, 2014 with the Korean Intellectual Property Office, the entirety of which is incorporated herein by reference.

BACKGROUND

The present disclosure relates to an electronic component and a method for manufacturing the same.

An inductor, an electronic component, is a representative passive element that can be configured in an electronic circuit together with a resistor and a capacitor to remove noise.

A thin-film type inductor is manufactured by forming internal coil parts, stacking, compressing, and hardening magnetic sheets formed of a mixture of a magnetic powder and a resin to manufacture a magnetic body, and forming external electrodes on outer surfaces of the magnetic body.

SUMMARY

One aspect of the present disclosure may provide an electronic component having a color as well as improved dispersibility and an improved packing factor of magnetic metal powder particles included therein, and a method for manufacturing the same.

According to an aspect of the present disclosure, an electronic component comprising a magnetic body containing internal coil parts, wherein the magnetic body includes: a magnetic metal powder; a thermosetting resin; and a color coupler.

The color coupler may be at least one selected from the group consisting of a dye and a pigment.

The color coupler may not decompose at a curing temperature of the thermosetting resin.

A content of the color coupler may be 0.01 to 0.1 parts by weight, based on a total weight of the magnetic metal powder and the color coupler.

The color coupler may contain at least one chromophore selected from the group consisting of —N═O—, —C═O—, —N═N—, —C═C—, —C═N—, —C═S—, —N═O—, and —N═NO—.

The color coupler may contain at least one soluble group selected from the group consisting of a carboxyl group (—COOH), a sulfonic acid group (—SO3H), and a hydroxyl group (—OH).

The color coupler may contain an alloy or a metal oxide containing at least one selected from the group consisting of Zn, Pb, Sb, Ti, Fe, As, Co, Mg, Al, Cr, Cu, Ba, Bi, and Ca.

The color coupler may contain an alloy or a metal oxide containing at least one selected from the group consisting of Fe, Co, Cr, and Cu.

According to another aspect of the present disclosure, a method for manufacturing an electronic component comprises steps of: forming internal coil parts; and forming magnetic sheets on and below the internal coil parts, and compressing and curing the magnetic sheets to form a magnetic body in which the internal coil parts are embedded, wherein the magnetic sheets include a magnetic metal powder, a thermosetting resin, and a color coupler.

BRIEF DESCRIPTION OF DRAWINGS

The above and other aspects, features and advantages of the present disclosure will be more clearly understood from the following detailed description taken in conjunction with the accompanying drawings.

DETAILED DESCRIPTION

Figure 1:
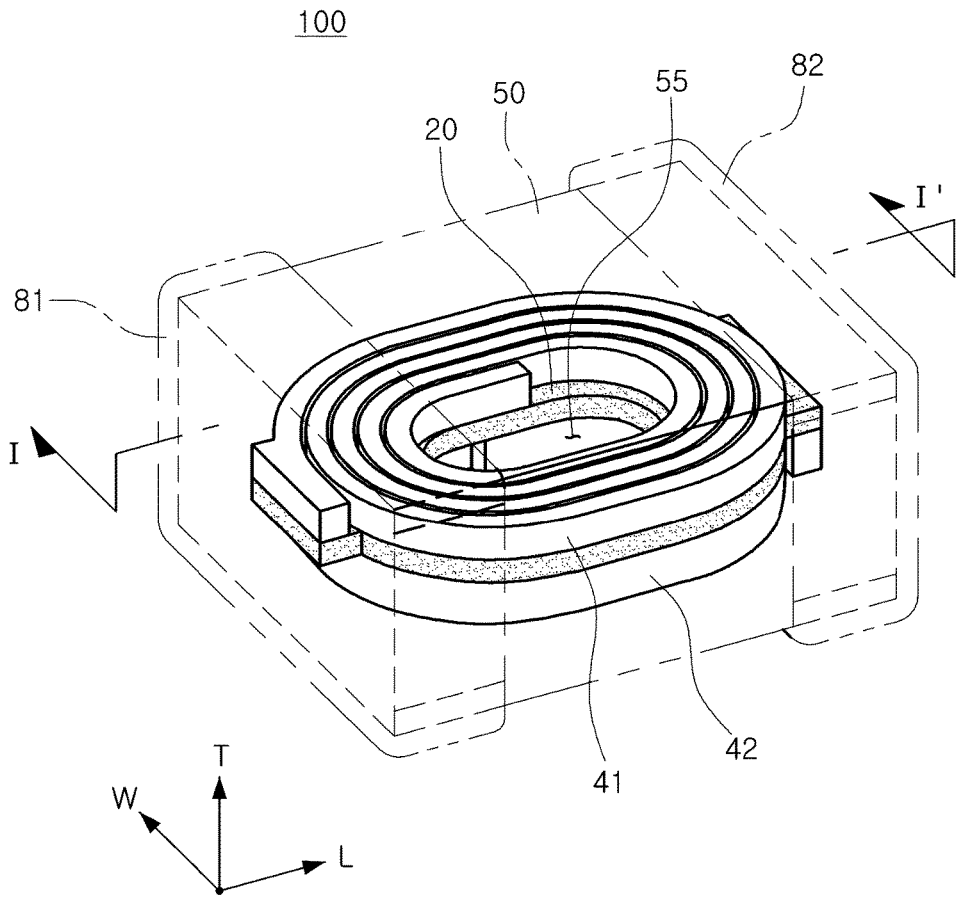
FIG. 1 is a schematic perspective view illustrating an electronic component including internal coil parts according to one exemplary embodiment.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Electronic Component

Hereinafter, an electronic component, according to an exemplary embodiment, in particular, a thin-film type inductor, will be described. However, the electronic component is not limited thereto.

FIG. 1 is a schematic perspective view illustrating an electronic component including internal coil parts according to an exemplary embodiment.

Referring to FIG. 1, a thin-film type inductor used in a power line of a power supply circuit is illustrated as an example of the electronic component.

An electronic component 100 may include a magnetic body 50, internal coil parts 41 and 42 embedded in the magnetic body 50, and first and second external electrodes 81 and 82 disposed on outer surfaces of the magnetic body 50 and electrically connected to the internal coil parts 41 and 42.

In the electronic component 100, a "length" direction refers to an "L" direction of FIG. 1, a "width" direction refers to a "W" direction of FIG. 1, and a "thickness" direction refers to a "T" direction of FIG. 1.

Figure 2:
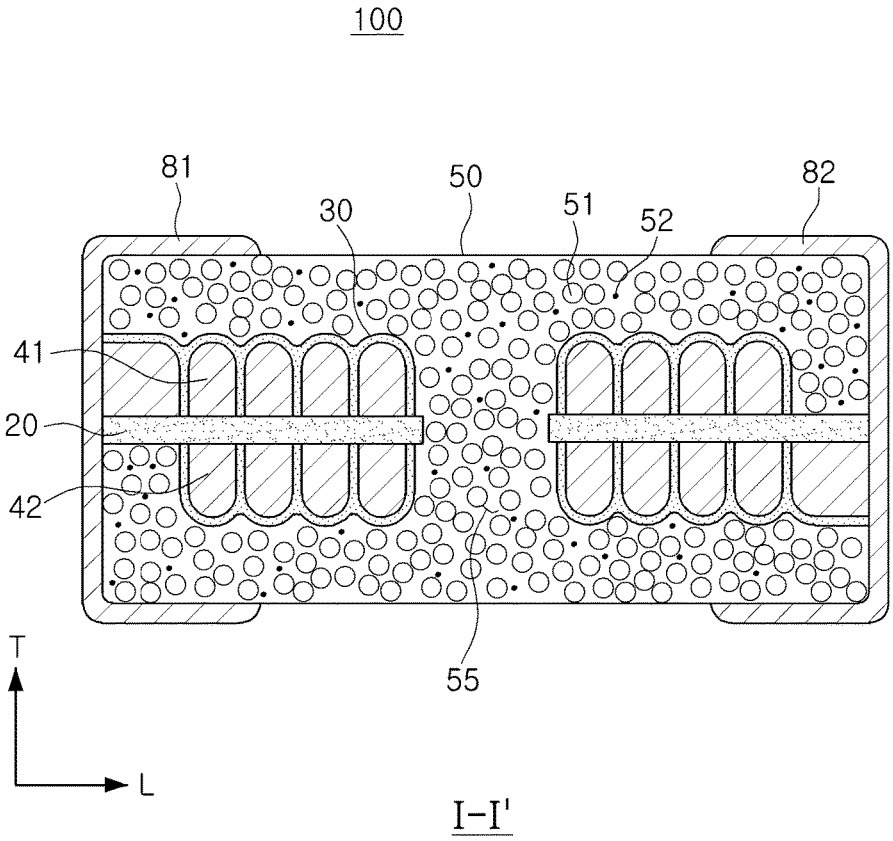
FIG. 2 is a cross-sectional view taken along line I-I' of FIG. 1.

FIG. 2 is a cross-sectional view taken along line I-I' of FIG. 1.

Referring to FIG. 2, the magnetic body 50 may form the overall shape of the electronic component 100, and may be formed by stacking, compressing, and hardening magnetic sheets.

The magnetic body 50 may contain magnetic metal powder 51.

The magnetic metal powder 51 may contain at least one selected from the group consisting of Fe, Si, Cr, Al, and Ni. For example, the magnetic metal powder 51 may contain an Fe—Si—B—Cr based amorphous metal, but is not limited thereto.

The magnetic metal powder 51 may have a particle diameter of 0.1 μm to 30 μm.

The magnetic metal powder 51 may be contained in a thermosetting resin, and the magnetic metal powder may be dispersed in the thermosetting resin.

The thermosetting resin may be at least one selected from the group consisting of an epoxy resin and a polyimide resin, but is not limited thereto.

The magnetic body 50, according to the exemplary embodiment, may contain a color coupler 52.

The color coupler 52 may be a material contained in the magnetic body 50 to provide three primary colors, red, blue, and yellow, and various colors in which the red, blue, and yellow are mixed together.

The electronic component 100, according to the exemplary embodiment, may contain the color coupler 52 having various colors, and electronic components of various types and sizes may be distinguished from each other depending on colors thereof.

The color coupler 52 may be at least one selected from the group consisting of a dye and a pigment.

The dye is a material soluble in water or oil to provide color, and the pigment is a color coupler that is not soluble in water or oil.

The color coupler 52 may not be decomposed at a curing temperature of the thermosetting resin.

In a case in which an inductor, according to another exemplary embodiment, is manufactured using ferrite through a sintering process, the color coupler is decomposed or is present as impurities in a high-temperature sintering process to cause non-uniform grain growth, non-sintering, second phase generation, and the like, thereby deteriorating magnetic characteristics.

However, in the exemplary embodiment, since the curing of the thermosetting resin rather than the sintering thereof is performed in a state in which the magnetic metal powder 51 is dispersed in the thermosetting resin, the color coupler 52 may be formed of any material that is not decomposed at a curing temperature, for example, about 180° C.

The color coupler 52 may contain a chromophore that provides color, and since a range of wavelengths of reflected light differs according to a structure of the chromophore, a desired color of the electronic component may be obtained by appropriately controlling the structure of the chromophore.

For example, the color coupler 52 may contain at least one chromophore selected from the group consisting of —N═O—, —C═O—, —N═N—, —C═C—, —C═N—, —C═S—, —N═O—, and —N═NO—.

The color coupler 52 may have the form of metallic salts containing Ca, Ba, Mn, Sr, Na, or the like, and since a range of wavelengths of reflected light differs according to types of metallic salts, a desired color of the electronic component may be obtained by appropriately controlling the types of metallic salts.

In addition, the color coupler 52 may contain at least one soluble group selected from the group consisting of a carboxyl group (—COOH), a sulfonic acid group (—$SO_3H$), and a hydroxyl group (—OH).

Meanwhile, as the sizes of electronic components have gradually decreased and demand for higher degrees of functionality have increased, the magnetic metal powder has been grain-refined, and mixtures of two or more types of magnetic metal powder having different particle sizes have been used. Therefore, it has become more difficult to disperse the magnetic metal powder. Accordingly, more effective methods that may provide high levels of dispersibility have been demanded.

Therefore, according to the exemplary embodiment, the magnetic body 50 may contain the color coupler 52 to implement various colors. Further, the color coupler 52 may serve as a dispersing agent to obtain excellent dispersibility and a sedimentation preventing effect in the magnetic metal powder.

For example, the color coupler 52, according to the exemplary embodiment, containing the hydroxyl group (—OH) may be adsorbed onto the magnetic metal powder 51 to generate steric hindrance in the magnetic metal powder 51 and prevent coagulation in the magnetic metal powder 51, thereby improving dispersibility.

The color coupler 52, according to another exemplary embodiment, may contain an alloy or a metal oxide containing at least one selected from the group consisting of Zn, Pb, Sb, Ti, Fe, As, Co, Mg, Al, Cr, Cu, Ba, Bi, and Ca.

For example, the color coupler 52, according to another exemplary embodiment, may contain a Cu—Zn alloy, ZnO, $2PbCO_3$, CdS, $TiO_2$—NiO—$Sb_2O_8$, $Cu_2O$, or the like.

The color coupler 52 containing the alloy or the metal oxide may have a particle size of 50 nm to 500 nm.

Here, an alloy or a metal oxide containing at least one selected from the group consisting of Fe, Co, Cr, and Cu in the color coupler 52 may have magnetic properties.

For example, the color coupler 52, according to the exemplary embodiment, having magnetic properties may be $Fe_2O_3$, or the like.

In an exemplary embodiment in the present disclosure, the magnetic body may contain the color coupler 52 having magnetic properties to implement colors in the electronic component. Further, the color coupler 52 may serve as the magnetic material, such that a packing factor may be improved and capacity and efficiency of the electronic component may be improved.

The content of the color coupler 52 may be 0.01 to 0.1 parts by weight on the basis of 100 parts by weight of the magnetic metal powder 51 and the color coupler 52 contained in the magnetic body 50.

When the content of the color coupler 52 is less than 0.01 parts by weight, it may be difficult to distinguish the color with the naked eye, and improvements in dispersibility and sedimentation stability of the magnetic metal powder may be insufficient, and when the content of the color coupler 52 exceeds 0.1 parts by weight, it may not be effective in implementing color, and dispersibility and sedimentation stability of the magnetic metal powder may be deteriorated.

A first internal coil part 41 including a coil pattern may be formed on one surface of an insulating substrate 20 disposed in the magnetic body 50, and a second internal coil part 42 including a coil pattern may be formed on the other surface of the insulating substrate 20.

The insulating substrate 20 may be, for example, a polypropylene glycol (PPG) substrate, a ferrite substrate, a metal-based soft magnetic substrate, or the like.

The insulating substrate 20 may have a through-hole formed in a central portion thereof to penetrate through the central portion thereof, wherein the through-hole may be filled with the magnetic metal powder 51 to form a core part 55. By filling the core part 55 with the magnetic metal powder 51, inductance may be improved.

The internal coil parts 41 and 42 may include coil patterns having a spiral shape, and the first and second internal coil parts 41 and 42 formed on one surface and the other surface of the insulating substrate 20, respectively, may be electrically connected to each other through a via (not illustrated) penetrating through the insulating substrate 20.

The internal coil parts 41 and 42 and the via may be formed of a metal having excellent electrical conductivity, such as silver (Ag), palladium (Pd), aluminum (Al), nickel (Ni), titanium (Ti), gold (Au), copper (Cu), platinum (Pt), or an alloy thereof.

The internal coil parts 41 and 42 may be coated with an insulating film 30.

The internal coil parts 41 and 42 may be coated with the insulating film 30, so that they may not directly contact the magnetic material forming the magnetic body 50.

One end portion of the first internal coil part 41 formed on one surface of the insulating substrate 20 may be exposed to one end surface of the magnetic body 50 in the length L direction, and one end portion of the second internal coil part 42 formed on the other surface of the insulating substrate 20 may be exposed to the other end surface of the magnetic body 50 in the length L direction.

The first and second external electrodes 81 and 82 may be formed on both end surfaces of the magnetic body 50 in the length L direction, respectively, to be connected to the first and second internal coil parts 41 and 42 exposed to both end surfaces of the magnetic body 50 in the length L direction, respectively.

The external electrodes 81 and 82 may include conductive resin layers and plating layers formed on the conductive resin layers, respectively.

The conductive resin layer may contain at least one conductive metal selected from the group consisting of copper (Cu), nickel (Ni), and silver (Ag), and a thermosetting resin.

The thermosetting resin may be an epoxy resin, a polyimide resin, or the like.

The plating layer may contain at least one selected from the group consisting of nickel (Ni), copper (Cu), and tin (Sn). For example, a nickel (Ni) layer and a tin (Sn) layer may be sequentially formed as the plating layer.

Method for Manufacturing Electronic Component

Figure 3:
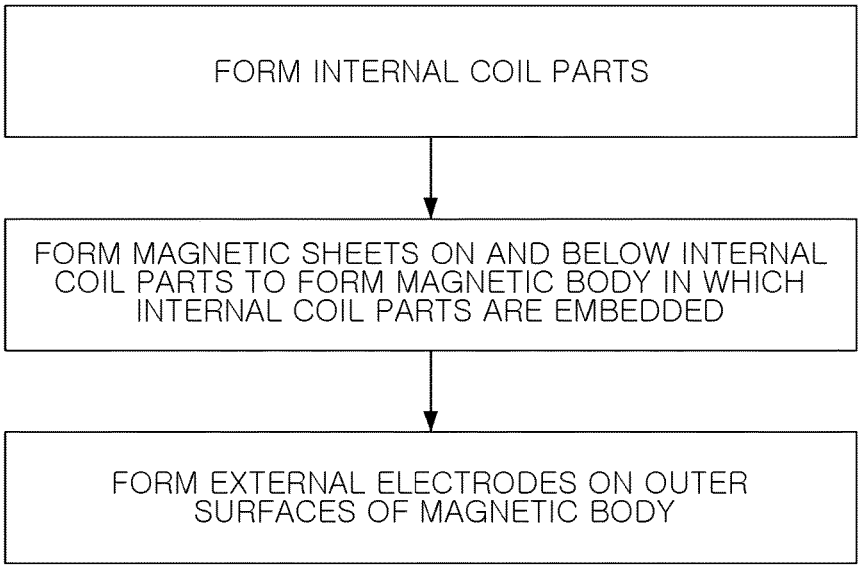
FIG. 3 is a flowchart illustrating a method for manufacturing an electronic component, according to an exemplary embodiment.

FIG. 3 is a flowchart illustrating a method for manufacturing an electronic component according to an exemplary embodiment.

Referring to FIG. 3, the internal coil parts 41 and 42 may be formed.

The internal coil parts 41 and 42 may be formed on the insulating substrate 20 through electroplating, but are not limited thereto.

A through-hole may be formed in a portion of the insulating substrate 20 and may be filled with a conductive material to form the via, and the first and second internal coil parts 41 and 42 formed on one surface and the other surface of the insulating substrate 20, respectively, may be electrically connected to each other through the via.

Drilling, laser processing, sand blasting, punching, or the like, may be performed on a central portion of the insulating substrate 20 to form the through-hole penetrating through the insulating substrate 20.

Next, the insulating film 30 coating the first and second internal coil parts 41 and 42 may be formed.

The insulating film 30 may be formed by a screen printing method, a photoresist (PR) exposure and development method, a spraying method, a chemical vapor deposition (CVD) method, or the like, but is not limited thereto.

Next, magnetic sheets may be formed on the internal coil parts 41 and 42 to form the magnetic body 50 in which the internal coil parts 41 and 42 are embedded.

Slurry used to manufacture the magnetic sheets may contain the magnetic metal powder 51, a thermosetting resin, a hardener, a thickener, an organic solvent, a dispersing agent, and the like.

The magnetic metal powder 51 used to manufacture the magnetic sheets may contain at least one selected from the group consisting of Fe, Si, Cr, Al, and Ni. For example, the magnetic metal powder 51 may be an Fe—Si—B—Cr based amorphous metal, but is not limited thereto.

The magnetic metal powder 51 may be mixed with the thermosetting resin to form the slurry, and the slurry may be applied onto carrier films and then dried to manufacture the magnetic sheets.

The thermosetting resin may be at least one selected from the group consisting of an epoxy resin and a polyimide resin, but is not limited thereto.

Here, the slurry used to manufacture the magnetic sheet, according to the exemplary embodiment, may contain the color coupler 52.

The color coupler 52 may be at least one selected from the group consisting of a dye and a pigment.

The color coupler 52 may contain a chromophore that provides color, and since a range of wavelengths of reflected light differs according to a structure of the chromophore, a desired color of the electronic component may be obtained by appropriately controlling the structure of the chromophore.

For example, the color coupler 52 may contain at least one chromophore selected from the group consisting of —N═O—, —C═O—, —N═N—, —C═C—, —C═N—, —C═S—, —N═O—, and —N═NO—.

The color coupler 52 may have the form of a metallic salt containing Ca, Ba, Mn, Sr, Na, or the like, and since a range of wavelengths of reflected light differs according to types of metallic salts, a desired color of the electronic component may be obtained by appropriately controlling the types of metallic salts.

In addition, the color coupler 52 may contain at least one soluble group selected from the group consisting of a carboxyl group (—COOH), a sulfonic acid group (—$SO_3H$), and a hydroxyl group (—OH).

In an exemplary embodiment, the magnetic sheet may contain the color coupler 52 to implement various colors. Further, the color coupler 52 may serve as a dispersing agent to obtain excellent dispersibility and a sedimentation preventing effect of the magnetic metal powder.

For example, the color coupler 52, according to an exemplary embodiment, containing the hydroxyl group (—OH) may be adsorbed onto the magnetic metal powder 51 to generate steric hindrance in the magnetic metal powder 51 and prevent coagulation in the magnetic metal powder 51, thereby improving dispersibility.

The color coupler 52, according to another exemplary embodiment, may contain an alloy or a metal oxide containing at least one selected from the group consisting of Zn, Pb, Sb, Ti, Fe, As, Co, Mg, Al, Cr, Cu, Ba, Bi, and Ca.

For example, the color coupler 52, according to another exemplary embodiment, may contain a Cu—Zn alloy, ZnO, $2PbCO_2$, CdS, $TiO_2$—NiO—$Sb_2O_8$, $Cu_2O$, or the like.

The color coupler 52 containing the alloy or the metal oxide may have a particle size of 50 nm to 500 nm.

Here, an alloy or a metal oxide containing at least one selected from the group consisting of Fe, Co, Cr, and Cu in the color coupler 52 may have magnetic properties.

For example, the color coupler 52, according to the exemplary embodiment, having magnetic properties may be $Fe_2O_3$, or the like.

In an exemplary embodiment, the magnetic sheet may contain the color coupler 52 having magnetic properties to implement colors in the electronic component. Further, the color coupler 52 may serve as the magnetic material, so that a packing factor may be improved and capacity and efficiency of the electronic component may be improved.

The content of the color coupler 52 may be 0.01 to 0.1 parts by weight on the basis of 100 parts by weight of the magnetic metal powder 51 and the color coupler 52 contained in the magnetic sheet.

When the content of the color coupler 52 is less than 0.01 parts by weight, it may be difficult to distinguish the color with the naked eye, and improvements in dispersibility and sedimentation stability of the magnetic metal powder may be insufficient. When the content of the color coupler 52 exceeds 0.1 parts by weight, it may not be effective in implementing color, and dispersibility and sedimentation stability of the magnetic metal powder may be deteriorated.

Figure 4:
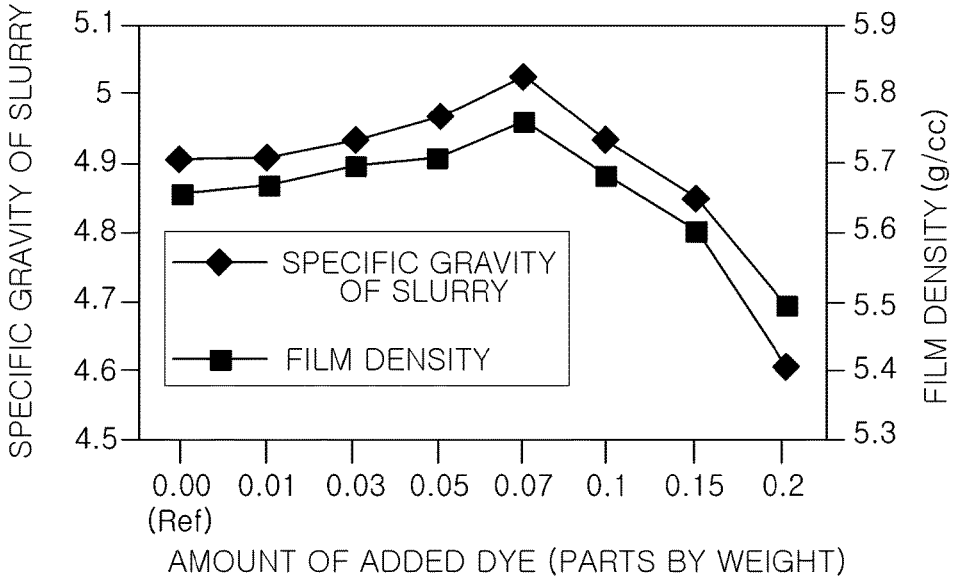
FIG. 4 is a graph illustrating the comparison results of specific gravities of slurry and film densities of a magnetic sheet depending on the content of a color coupler.

FIG. 4 is a graph illustrating the comparison results of specific gravities of slurry and film densities of a magnetic sheet depending on the content of a color coupler having a chromophore of —N═N— and a hydroxyl group (—OH).

It can be seen from FIG. 4 that a specific gravity and a film density of the slurry are improved when the content of the color coupler is 0.01 to 0.1 parts by weight on the basis of 100 parts by weight of the magnetic metal powder and the color coupler.

In particular, the specific gravity and the film density of the slurry were continuously improved when the content of the color coupler was 0.01 to 0.07 parts by weight.

Meanwhile, it was difficult to distinguish the color with the naked eye when the content of the color coupler was less than 0.01 parts by weight, and the specific gravity and the film density of the slurry were decreased when the content of the color coupler exceeded 0.1 parts by weight.

The plurality of magnetic sheets may be stacked on both surfaces of the internal coil parts 41 and 42, compressed by a laminate method or an isostatic press method, and cured to form the magnetic body 50.

Here, the color coupler 52 may not be decomposed during curing.

In the case of the inductor manufactured using ferrite through the sintering process, the color coupler may be decomposed or may be present as impurities in a high-temperature sintering process to cause non-uniform grain growth, non-sintering, second phase generation, and the like, thereby deteriorating magnetic characteristics.

However, in an exemplary embodiment, since the magnetic body is manufactured by stacking the magnetic sheets in which the magnetic metal powder 51 is dispersed in the thermosetting resin and performing the curing of the thermosetting resin rather than the sintering thereof, the color coupler 52 may be formed of any material that is not decomposed at a curing temperature, for example, about 180° C.

Next, the external electrodes 81 and 82 may be formed on both end surfaces of the magnetic body 50 in the length L direction, respectively, to be connected to the internal coil parts 41 and 42 exposed to both end surfaces of the magnetic body 50 in the length L direction, respectively.

The conductive resin layers may be formed on both end surfaces of the magnetic body 50 in the length L direction, and the plating layers may be formed on the conductive resin layers.

The conductive resin layer may be formed of a paste containing at least one conductive metal selected from the group consisting of copper (Cu), nickel (Ni), and silver (Ag), and a thermosetting resin, and be formed by, for example, a dipping method, or the like.

For example, a nickel (Ni) layer and a tin (Sn) layer may be sequentially formed as the plating layer.

As set forth above, according to exemplary embodiments, the electronic component having a color as well as the sedimentation preventing effect and excellent dispersibility of magnetic metal powder included therein may be manufactured. In addition, the packing factor of the magnetic metal powder may be improved to secure high inductance.

While exemplary embodiments have been shown and described above, it will be apparent to those skilled in the art that modifications and variations could be made without departing from the scope of the present inventive concept as defined by the appended claims.

What is claimed is:

1. An electronic component comprising a magnetic body containing internal coil parts, wherein the magnetic body includes:

a magnetic metal powder;

a thermosetting resin; and a magnetic color coupler, wherein the color coupler is dispersed in the magnetic body.

2. The electronic component of claim 1, wherein the color coupler is at least one selected from the group consisting of a dye and a pigment.

3. The electronic component of claim 1, wherein the color coupler is not decomposed at a curing temperature of the thermosetting resin.

4. The electronic component of claim 1, wherein a content of the color coupler is 0.01 to 0.1 parts by weight, based on a total weight of the magnetic metal powder and the color coupler.

5. The electronic component of claim 1, wherein the color coupler contains at least one chromophore selected from the group consisting of —N═O—, —C═O—, —N═N—, —C═C—, —C═N—, —C═S—, —N═O—, and —N═NO—.

6. The electronic component of claim 1, wherein the color coupler contains at least one soluble group selected from the group consisting of a carboxyl group (—COOH), a sulfonic acid group (—$SO_3H$), and a hydroxyl group (—OH).

7. The electronic component of claim 1, wherein the color coupler contains an alloy or a metal oxide containing at least one selected from the group consisting of Zn, Pb, Sb, Ti, Fe, As, Co, Mg, Al, Cr, Cu, Ba, Bi, and Ca.

8. The electronic component of claim 1, wherein the color coupler contains an alloy or a metal oxide containing at least one selected from the group consisting of Fe, Co, Cr, and Cu.

9. The electronic component of claim 1, wherein the color coupler is adsorbed onto the magnetic metal powder.

* * * * *